US008104881B2

(12) United States Patent
Itoh

(10) Patent No.: US 8,104,881 B2
(45) Date of Patent: Jan. 31, 2012

(54) INK CARTRIDGE, INK CARTRIDGE BAG, AND INKJET RECORDING APPARATUS

(75) Inventor: Fumihiko Itoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1042 days.

(21) Appl. No.: 11/996,833

(22) PCT Filed: May 15, 2007

(86) PCT No.: PCT/JP2007/060323

§ 371 (c)(1),
(2), (4) Date: Jan. 25, 2008

(87) PCT Pub. No.: WO2007/142016

PCT Pub. Date: Dec. 13, 2007

(65) Prior Publication Data

US 2009/0102901 A1 Apr. 23, 2009

(30) Foreign Application Priority Data

Jun. 8, 2006 (JP) ..... 2006-159198
Mar. 2, 2007 (JP) ..... 2007-052218

(51) Int. Cl.
*B41J 2/175* (2006.01)

(52) U.S. Cl. ..... 347/86; 347/85

(58) Field of Classification Search ..... 347/85, 347/86

See application file for complete search history.

(56) References Cited

U.S. PATENT DOCUMENTS 5,790,157 A 8/1998 Higuma et al.
6,234,615 B1 * 5/2001 Tsukuda ..... 347/85
6,247,803 B1 6/2001 Kanaya et al.
2004/0036748 A1 * 2/2004 Asano et al. ..... 347/85
2005/0134663 A1 6/2005 Sasaki et al.
2006/0176348 A1 * 8/2006 Nishioka et al. ..... 347/86

FOREIGN PATENT DOCUMENTS

EP 0640484 A2 3/1995
EP 0676293 A2 10/1995
JP 1-133750 5/1989
JP 2-24151 1/1990

(Continued)

OTHER PUBLICATIONS

Jun. 29, 2009 European search report in connection with a counterpart European patent application No. 07 74 3757.

(Continued)

*Primary Examiner* — Matthew Luu
*Assistant Examiner* — Jannelle M Lebron
(74) *Attorney, Agent, or Firm* — Cooper & Dunham LLP

(57) ABSTRACT

A disclosed ink cartridge includes a primary ink room and at least one secondary ink room arranged adjacent to the primary ink room, which rooms are configured to store ink therein. An ink supplying needle is made to pierce through the secondary ink room in such a manner that at least a needle hole provided in the ink supplying needle reaches the primary ink room so as to suction the ink from the primary ink room through the needle hole and supply the ink to an inkjet recording head via an ink supplying path. As the ink supplying needle is pulled out from the primary ink room, the needle hole passes through the secondary ink room so that the ink supplying needle can suction the ink from the secondary ink room.

14 Claims, 4 Drawing Sheets

FOREIGN PATENT DOCUMENTS

| | | | |
|---|---|---|---|
| JP | 6-967 | | 1/1994 |
| JP | 7-290719 | | 11/1995 |
| JP | 07290719 | A * | 11/1995 |
| JP | 7-323564 | | 12/1995 |
| JP | 9-187961 | | 7/1997 |
| JP | 2852914 | | 11/1998 |
| JP | 2000-6432 | | 1/2000 |
| JP | 2003-334962 | | 11/2003 |
| JP | 2005-28614 | | 2/2005 |
| JP | 3689267 | | 6/2005 |
| JP | 2006-75663 | | 3/2006 |
| WO | WO 2005/051666 | A1 | 6/2005 |

OTHER PUBLICATIONS

Oct. 9, 2009 Chinese official action (and English translation thereof) in connection with a counterpart Chinese patent application No. 2007800009235.

* cited by examiner

INK CARTRIDGE, INK CARTRIDGE BAG, AND INKJET RECORDING APPARATUS

TECHNICAL FIELD

The present invention relates to a replaceable ink cartridge or an ink cartridge bag and an inkjet recording apparatus employing the same.

BACKGROUND ART

An inkjet recording apparatus employing a replaceable ink cartridge/ink cartridge bag can be classified into two types. The first type has an ink cartridge and a head provided as a single integral unit. The second type has an ink cartridge and a head provided separately, and also has an ink tank (also referred to as a head tank or a sub tank) connected to the head.

FIG. 1 is a conceptual diagram of an inkjet recording apparatus 10 with the ink cartridges and the head provided as a single integral unit. A recording element substrate is provided on the bottom surface of a box-shaped recording head 11. On top of the recording head 11, there are mounted ink tanks 12*k*, 12*c*, 12*m*, and 12*y* containing ink of various colors, e.g., black (hereinafter, "k"), cyan (hereinafter, "c"), magenta (hereinafter, "m"), and yellow (hereinafter, "y"). The inkjet recording apparatus 10 further includes a scanner 13, a conveying device 14, a sheet feeding tray 15, and a guide bar 16 of the recording head 11.

In such an inkjet recording apparatus in which the ink cartridge and the head are provided as a single integral unit, the ink flows as follows. Specifically, black ink inside the ink tank 12*k* is supplied into the recording head 11 through an ink supplying opening of the ink tank 12*k* and a joint, and is supplied to an ink supplying opening of the not shown recording element substrate through an ink flow path in the recording head 11.

FIG. 2 is a conceptual diagram of an inkjet recording apparatus 20 with ink cartridges and a head provided separately. Ink cartridges 21*k*, 21*c*, 21*m*, and 21*y* containing ink of various colors as in the example shown in FIG. 1, e.g., black (k), cyan (c), magenta (m), and yellow (y) are provided at the bottom part of the main unit of the inkjet recording apparatus 20. Ink tanks (sub tanks) 22*k*, 22*c*, 22*m*, and 22*y* for storing ink are mounted on top of the recording head 11. Although not shown, there are ink supplying needles with sharp tips provided in the main unit of the inkjet recording apparatus 20 where the ink cartridges 21*k*, 21*c*, 21*m*, and 21*y* are set. The ink cartridges are stabbed by these ink supplying needles and connected to the inkjet recording apparatus 20. The other ends of the ink supplying needles are connected to a bendable ink supplying tube 17, so that ink is supplied to an ink tank 22 through the ink supplying tube 17. In FIG. 2, elements corresponding to those in FIG. 1 are denoted by the same reference numbers.

If an inkjet recording apparatus performs a printing operation when there is no ink remaining in an ink cartridge, a desirable printing quality cannot be attained and a failure occurs in the recording head, particularly if the recording head is a thermal type. Furthermore, if an attempt to supply ink is made when there is no ink remaining in an ink cartridge, the pressure decreases in the middle of an ink supplying path or inside the cartridge. This causes air to enter the ink supplying system when the cartridge is replaced subsequently.

In order to avoid the above-described failures, the inkjet recording apparatus needs to have a mechanism for detecting that there is no ink remaining in an ink cartridge (also referred to as an ink end status).

There have been many proposed techniques for determining the remaining amount of ink inside an ink cartridge. As one example of determining the amount of remaining ink, patent document 1 discloses a method of detecting the amount of remaining ink inside an ink cartridge by using an electrode pin. Patent document 2 discloses a method of optically detecting the amount of remaining ink. In both methods, the ink cartridge is provided with additional equipment for detecting the amount of ink remaining inside the ink cartridge, and therefore, the ink cartridge becomes complex and expensive.

Another method of determining the remaining amount of ink is to calculate the amount of ejected ink. However, the ejection amount varies, and therefore, the actual amount of ink consumed may not correspond to the assumed amount of ink consumed. Furthermore, in order to prevent air from entering the ink supplying system, it is necessary to leave a certain amount of ink in the ink cartridge, taking into account the variation in the ejection amount.

Patent document 3 discloses a cartridge with an area therein for collecting air. Patent document 4 discloses an ink cartridge with two ink bags therein. However, if the ink cartridge is removed (from the apparatus) when both ink bags are empty and the negative pressure is high in the ink conveying path, air would enter the ink conveying path. Patent document 3 describes a method of removing air that has entered the cartridge. However, by employing such a method, the ink cartridge becomes complex and expensive.

Patent Document 1: Japanese Laid-Open Patent Application No. H8-645

Patent Document 2: Japanese Laid-Open Patent Application No. 2003-193340

Patent Document 3: Japanese Laid-Open Patent Application No. H11-182759

Patent Document 4: Japanese Laid-Open Patent Application No. H4-183116

In either of the above-described types of inkjet printers, it is desirable to completely consume the ink inside an ink cartridge. However, it is difficult to immediately detect an ink end status when the ink is completely consumed. If the ink end status is detected a few seconds after completely consuming the ink, the pressure in the middle of the ink conveying path may decrease, depending on the ink conveying method. Air may enter the ink supplying path and even the head tank by replacing the ink cartridge while the pressure is reduced. Air inside the ink supplying system may cause ink ejection failures in the inkjet recording apparatus.

If an attempt is made to convey ink from a completely empty ink cartridge or ink cartridge bag after the ink is completely consumed, the pressure inside the ink cartridge or ink cartridge bag decreases. When the ink cartridge or the ink cartridge bag is removed in such a status, the hollow needle for suctioning ink with reduced pressure therein contacts the atmospheric air. As a result, air from outside enters the ink feeding path through the needle hole.

BRIEF SUMMARY

In an aspect of this disclosure, there is provided ink cartridge, an ink cartridge bag, and an inkjet recording apparatus capable of preventing air from entering the ink conveying path when the ink cartridge or the ink cartridge bag is removed to be replaced, and with which ink can be substantially completely consumed.

In another aspect, there is provided an ink cartridge for supplying ink to an inkjet recording head, the ink cartridge including a primary ink room and at least one secondary ink room configured to store therein the ink, the secondary ink room being arranged adjacent to the primary ink room; and an ink supplying needle configured to suction the ink from the primary ink room and supply the ink to the inkjet recording head; wherein the ink supplying needle is made to pierce through the secondary ink room in such a manner that at least a needle hole provided in the ink supplying needle reaches the primary ink room so as to suction the ink from the primary ink room through the needle hole and supply the ink to the inkjet recording head via an ink supplying path, and as the ink supplying needle is pulled out from the primary ink room, the needle hole passes through the secondary ink room so that the ink supplying needle can suction the ink from the secondary ink room.

In another aspect, there is provided an ink cartridge bag for supplying ink to an inkjet recording head, the ink cartridge bag including a primary ink room and at least one secondary ink room configured to store therein the ink, the secondary ink room being arranged adjacent to the primary ink room; and an ink supplying needle configured to suction the ink from the primary ink room and supply the ink to the inkjet recording head; wherein the ink supplying needle is made to pierce through the secondary ink room in such a manner that a needle hole provided in the ink supplying needle reaches the primary ink room so as to suction the ink from the primary ink room through the needle hole and supply the ink to the inkjet recording head via an ink supplying path, and as the ink supplying needle is pulled out from the primary ink room, the needle hole passes through the secondary ink room so that the ink supplying needle can suction the ink from the secondary ink room.

Any of various embodiments of an ink cartridge, an ink cartridge bag, and an inkjet recording apparatus may be provided, which are capable of preventing air from entering the ink conveying path with a simple structure, and with which ink can be substantially completely consumed.

BEST MODE FOR CARRYING OUT THE INVENTION

A description is given, with reference to the accompanying drawings, of an embodiment of the present invention.

First Embodiment

Figure 1:
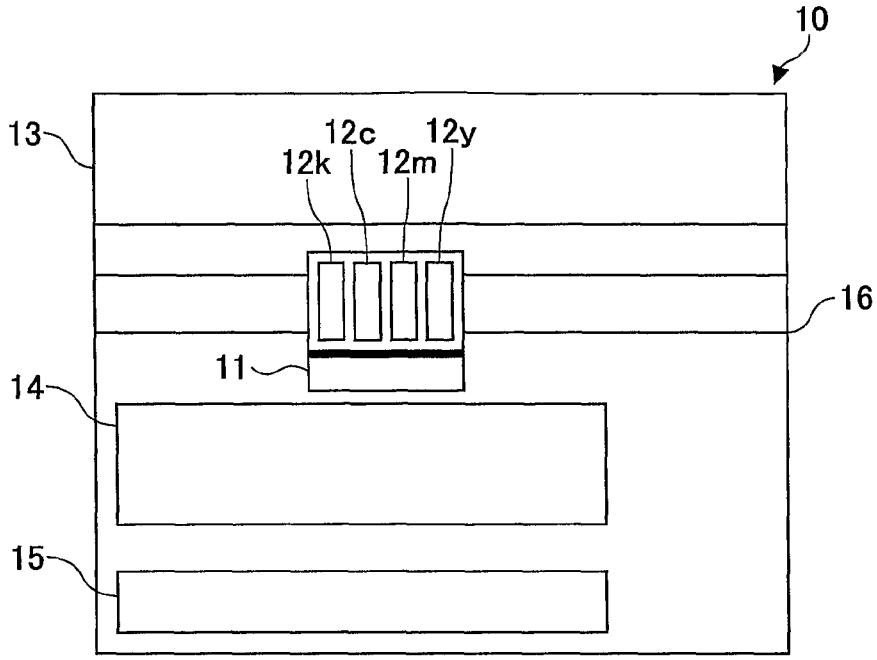
FIG. 1 is a conceptual diagram of an inkjet recording apparatus with ink cartridges and the head provided as a single integral unit.
Figure 2:
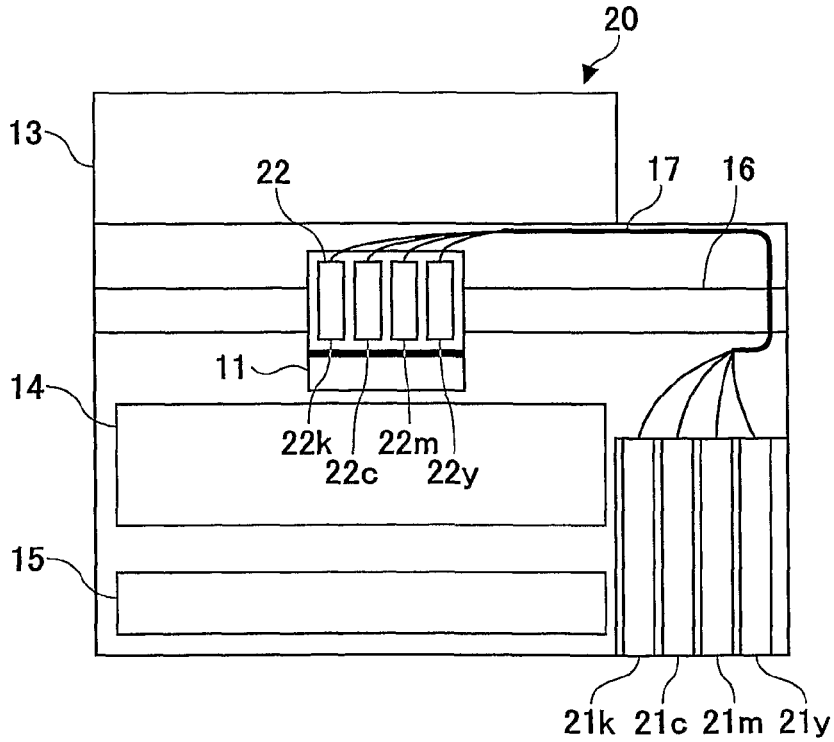
FIG. 2 is a conceptual diagram of an inkjet recording apparatus with ink cartridges and a head provided separately.
Figure 3A:
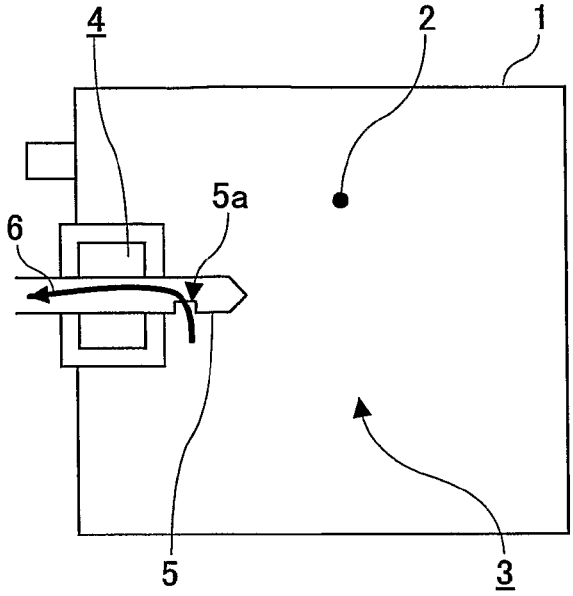
FIGS. 3A, 3B are sectional diagrams of ink cartridges according to a first embodiment of the present invention.
Figure 3B:
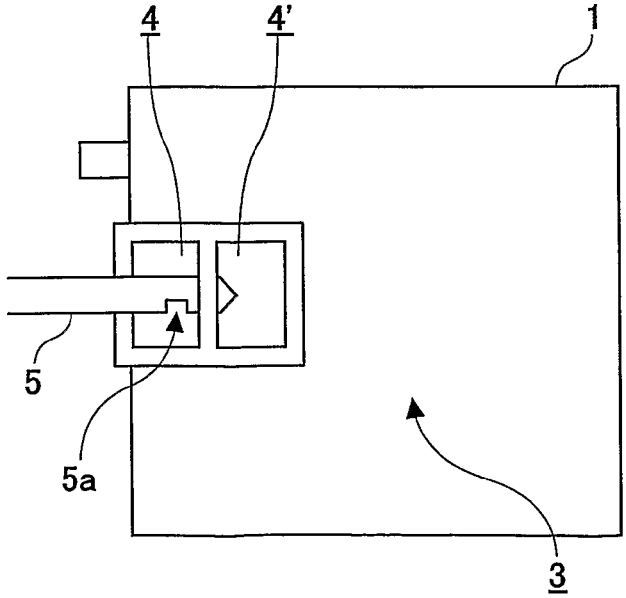

FIGS. 3A and 3B are schematic diagrams of an ink cartridge or an ink cartridge bag 1 (hereinafter, both are simply referred to as "ink cartridge" unless required otherwise) according to a first embodiment of the present invention. Inside the ink cartridge 1 are storage rooms for storing ink 2. Specifically, there is a first ink storage room 3, which is the primary storage room, and a second storage room 4, which is the secondary storage room provided mostly inside the first ink storage room 3. The ink cartridge 1 is preferably made of a material that has low moisture permeability and low air permeability, in consideration of preservability of the ink. As a matter of course, the secondary storage room is also preferably made of a material that has low moisture permeability and low air permeability. It is assumed that both of the storage rooms 3 and 4 are filled with ink of the same desired color by an appropriate method.

Most of the second storage room 4, which is the secondary storage room, is located inside the first ink storage room 3 in the first embodiment. However, the side into which a hollow needle 5 described below is inserted (pierces) is exposed outside, so that the hollow needle 5 can be directly inserted. The embodiment is not limited to providing a single second storage room 4. In a case where plural second storage rooms 4 are provided, the second storage room 4 that is arranged at the outermost position is preferably exposed outside. Specifically, at least part of the face of the outermost second storage room 4 pierced by the hollow needle 5 is exposed outside. Furthermore, the plural second storage rooms 4 are to be arranged in series along a direction in which the hollow needle 5 is inserted, as shown in FIG. 3B. At least the second storage room 4 preferably collapses when all of the ink 2 therein is consumed. With regard to the materials of the first ink storage room 3, the inside layer that contacts the ink is preferably made of polypropylene or polyethylene; the middle layer that controls the elasticity is preferably made of cyclic olefin copolymer; and the outermost gas-barrier layer is preferably made of EVOH (saponificated EVA (ethylene-vinyl acetate copolymer resin)).

Figure 4A:
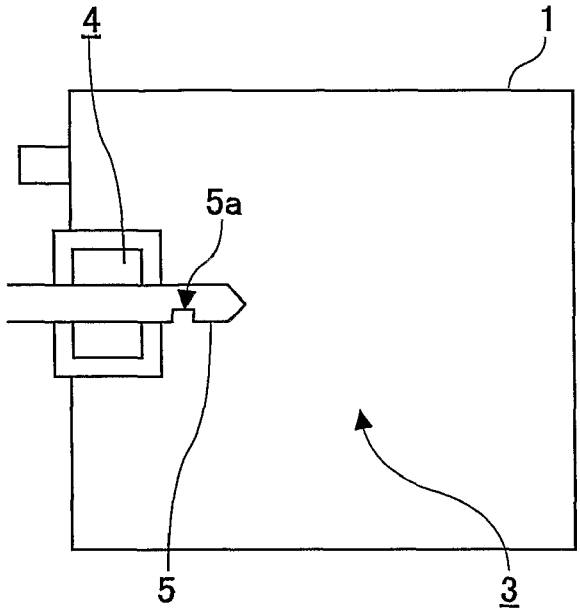
FIGS. 4A, 4B are sectional diagrams of the ink cartridges according to the first embodiment of the present invention.

Ink is supplied in a direction indicated by an arrow 6 shown in FIG. 3A. Referring to FIG. 4A, when the ink in the ink cartridge 1 is completely consumed, i.e., when the ink 2 in the first ink storage room 3 is completely consumed, the ink cartridge 1 is removed to be replaced. If the second storage room 4 were not provided, there would not be any ink remaining in the ink cartridge 1, and therefore, the pressure inside the ink cartridge 1 would be reduced. If the ink cartridge 1 is removed under such a status, the pulled-out hollow needle 5 contacts the atmospheric air while the pressure inside the ink flow path extending to the recording head is reduced. As a result, air from outside would flow into the ink flow path through a needle hole 5*a*.

Figure 4B:
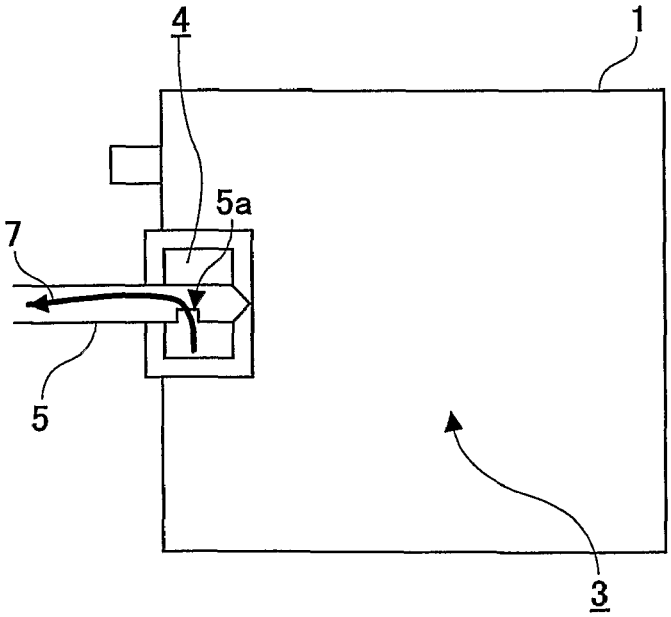

However, the first embodiment is provided with the second storage room 4. Therefore, while the ink cartridge 1 is being exchanged (see FIG. 4B), the ink inside the second storage room 4 is suctioned by negative pressure of the ink flow path and enters the ink flow path through the needle hole 5*a* of the hollow needle 5, as indicated by an arrow 7. Accordingly, the reduced pressure inside the ink supplying path is recovered (raised) so as to prevent air from flowing into the ink supplying path. With such a simple structure, the ink inside the ink cartridge 1 can be substantially completely consumed without letting air inside the ink supplying path. In the first embodiment, the exposed face of the second storage room 4 pierced by the hollow needle 5 is preferably made of a material that seals the hole after the hollow needle 5 is pulled out, in such a manner that not only the second storage room 4 but also the first ink storage room 3 are isolated from the atmospheric air. The same material is preferably used for the face acting as the partition between the second storage room 4 and the first ink storage room 3, so that the first ink storage room 3 and the second storage room 4 are separated when the hollow needle 5 is not inserted.

Second Embodiment

Figure 5:
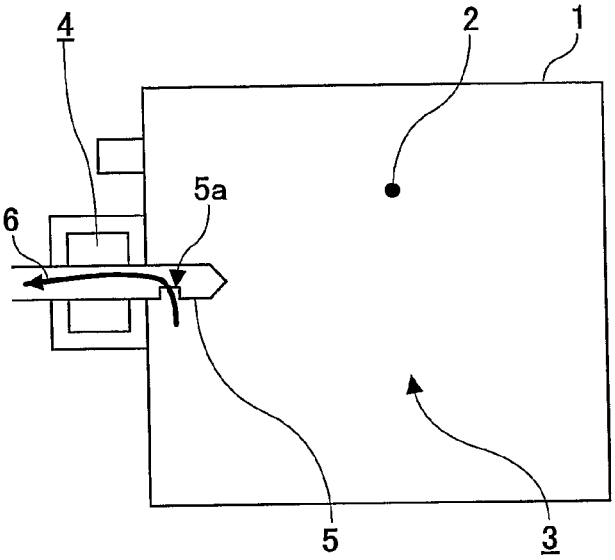
FIG. 5 is a sectional diagram of an ink cartridge according to a second embodiment of the present invention.

FIG. 5 illustrates a second embodiment in which the second storage room 4 is connected outside and adjacent to the first ink storage room 3. In the second embodiment, the face of the second storage room 4 facing the first ink storage room 3 is in contact with the first ink storage room 3. The hollow needle 5 needs to be inserted from the face of the second storage room 4 opposite to the face facing the first ink storage room 3. The second storage room 4 is also provided in the second embodiment. Therefore, when replacing the ink cartridge 1, the ink inside the second storage room 4 is suctioned by negative pressure of the ink flow path and enters the ink flow path through the needle hole 5*a* of the hollow needle 5. Accordingly, air is prevented from flowing into the ink supplying path, and the ink inside the ink cartridge 1 can be substantially completely consumed without letting air inside the ink supplying path. The status of suctioning ink from the second storage room 4 through the needle hole 5*a* of the hollow needle 5 is the same as the status shown in FIG. 4B, except for the point that the second storage room 4 is outside the first ink storage room 3 instead of being inside, and therefore, a diagram of such a status is omitted. In the second embodiment, both the first ink storage room 3 and the second storage room 4 are preferably made of a material that seals the hole after the hollow needle 5 is pulled out, in such a manner that the first ink storage room 3 and the second storage room 4 are isolated from the atmospheric air.

Third Embodiment

Figure 6:
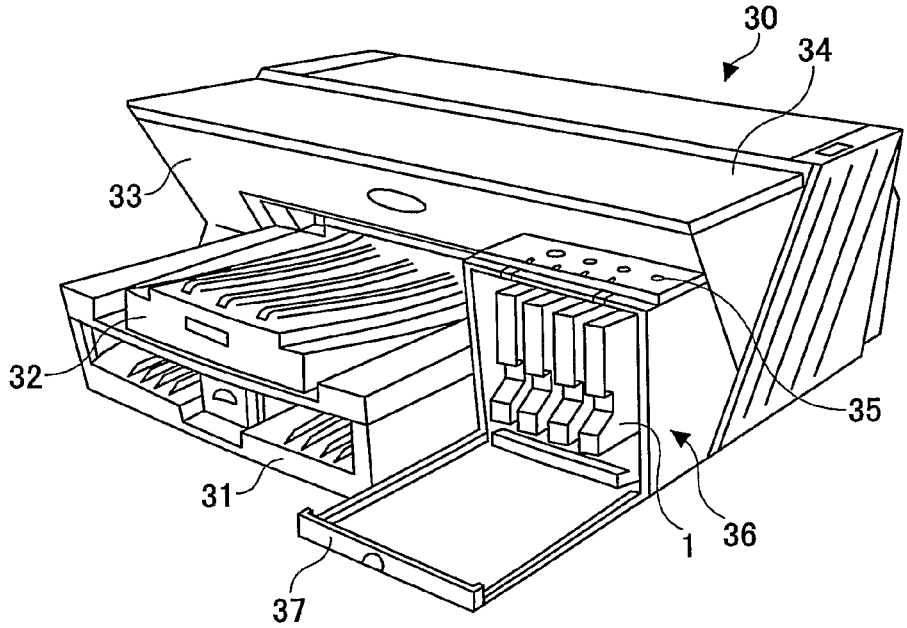
FIG. 6 is a perspective view of an inkjet recording apparatus according to a third embodiment of the present invention, to which the ink cartridges according to the above-described embodiments of the present invention can be applied.

FIG. 6 is a perspective view of an inkjet recording apparatus according to a third embodiment of the present invention, to which the ink cartridges according to the above-descried embodiments of the present invention can be applied. In this inkjet recording apparatus, the ink cartridges and the sub tanks are provided separately. As shown in FIG. 6, an inkjet printer 30 includes a paper feed unit 31, a paper eject unit 32, an apparatus main unit 33, an opening/closing cover 34, a display unit 35, an ink cartridge storing unit 36, and an opening/closing door 37 of the ink cartridge storing unit 36. The ink cartridge storing unit 36 has ink cartridges 1 for four colors detachably attached thereto. Although not shown, hollow needles are provided at the back of the ink cartridge storing unit 36 so that ink inside the ink cartridges 1 is supplied to the head through ink supplying tubes. The present invention is applicable not only to an inkjet recording apparatus with an ink cartridge and a head provided as a single integral unit but also to an inkjet recording apparatus to which the ink cartridge is detachably attached so as to be replaced.

The present invention is not limited to the specifically disclosed embodiment, and variations and modifications may be made without departing from the scope of the present invention.

The present application is based on Japanese Priority Patent Application No. 2006-159198, filed on Jun. 8, 2006 and Japanese Priority Patent Application No. 2007-052218, filed on Mar. 2, 2007, the entire contents of which are hereby incorporated by reference.

The invention claimed is:

1. An ink cartridge for supplying ink to an inkjet recording head, the ink cartridge comprising:

a primary ink room and at least one secondary ink room configured to store therein the ink, the secondary ink room being arranged adjacent to the primary ink room, and the secondary ink room being filled in advance with a specific amount of same type of ink as that stored in the primary ink room; and an ink supplying needle configured to suction the ink from the primary ink room and supply the ink to the inkjet recording head;

wherein the volume of ink stored in the secondary ink room, which is closer to the inkjet recording head than the primary ink room in an ink supply path from the ink cartridge to the inkjet recording head, is less than the volume of ink stored in the primary ink room which is further from the inkjet recording head than the secondary ink room in the ink supply path;

wherein the ink supplying needle is made to pierce through the secondary ink room in such a manner that at least a needle hole provided in the ink supplying needle reaches the primary ink room so as to suction the ink from the primary ink room through the needle hole and supply the ink to the inkjet recording head via the ink supply path, and as the ink supplying needle is pulled out from the primary ink room, the needle hole passes through the secondary ink room so that the ink supplying needle can suction the ink from the secondary ink room.

2. The ink cartridge according to claim 1, wherein the secondary ink room collapses when the ink therein is suctioned out.

3. The ink cartridge according to claim 1, wherein the secondary ink room is configured to communicate with the primary ink room.

4. The ink cartridge according to claim 1, wherein the needle hole of the ink supplying needle is configured in such a manner not to suction the ink from both the primary ink room and the secondary ink room at the same time.

5. The ink cartridge according to claim 1, wherein a plurality of the secondary ink rooms is provided and the needle hole passes through all of the secondary ink rooms so that the ink supplying needle can suction the ink from all of the secondary ink rooms.

6. The ink cartridge according to claim 1, wherein the secondary ink room includes (a) plural side walls and (b) a piercing wall through which the ink supplying needle pierces, and the side walls and the piercing wall are in contact, at a portion of the secondary ink room that is located inside the primary ink room, with the ink in the primary ink room.

7. The ink cartridge according to claim 1, wherein at least part of the secondary ink room is located inside the primary ink room.

8. An inkjet recording apparatus comprising the ink cartridge according to claim 1.

9. An ink cartridge bag for supplying ink to an inkjet recording head, the ink cartridge bag comprising:

a primary ink room and at least one secondary ink room configured to store therein the ink, the secondary ink room being arranged adjacent to the primary ink room, and the secondary ink room being filled in advance with a specific amount of a same type of ink as that stored in the primary ink room; and an ink supplying needle configured to suction the ink from the primary ink room and supply the ink to the inkjet recording head;

wherein the volume of ink stored in the secondary ink room, which is closer to the inkjet recording head than the primary ink room in an ink supply path from the ink cartridge to the inkjet recording head, is less than the volume of ink stored in the primary ink room which is further from the inkjet recording head than the secondary ink room in the ink supply path;

wherein the ink supplying needle is made to pierce through the secondary ink room in such a manner that a needle hole provided in the ink supplying needle reaches the primary ink room so as to suction the ink from the primary ink room through the needle hole and supply the ink to the inkjet recording head via the ink supply path, and as the ink supplying needle is pulled out from the primary ink room, the needle hole passes through the secondary ink room so that the ink supplying needle can suction the ink from the secondary ink room.

10. The ink cartridge bag according to claim 9, wherein the secondary ink room collapses when the ink therein is suctioned out.

11. The ink cartridge bag according to claim 9, wherein the secondary ink room is configured to communicate with the primary ink room.

12. The ink cartridge bag according to claim 9, wherein the needle hole of the ink supplying needle is configured in such a manner not to suction the ink from both the primary ink room and the secondary ink room at the same time.

13. The ink cartridge bag according to claim 9, wherein a plurality of the secondary ink rooms is provided and the needle hole passes through all of the secondary ink rooms so that the ink supplying needle can suction the ink from all of the secondary ink rooms.

14. An inkjet recording apparatus comprising the ink cartridge bag according to claim 9.

* * * * *